US010774803B2

(12) United States Patent
Okada

(10) Patent No.: US 10,774,803 B2
(45) Date of Patent: Sep. 15, 2020

(54) CONTROL DEVICE FOR INTERNAL COMBUSTION ENGINE

(71) Applicant: TOYOTA JIDOSHA KABUSHIKI KAISHA, Aichi-ken (JP)

(72) Inventor: Yoshihiro Okada, Susono (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 16/275,332

(22) Filed: Feb. 14, 2019

(65) Prior Publication Data

US 2019/0277241 A1 Sep. 12, 2019

(30) Foreign Application Priority Data

Mar. 12, 2018 (JP) ..... 2018-044668

(51) Int. Cl.

| | |
|---|---|
| ***F02D 19/12*** | (2006.01) |
| ***F02P 5/04*** | (2006.01) |
| ***F02M 25/028*** | (2006.01) |
| ***F02M 25/022*** | (2006.01) |
| ***F02B 47/02*** | (2006.01) |
| ***F02D 37/02*** | (2006.01) |

(52) U.S. Cl.

CPC ..... *F02P 5/045* (2013.01); *F02B 47/02* (2013.01); *F02D 19/12* (2013.01); *F02D 37/02* (2013.01); *F02M 25/028* (2013.01); *F02M 25/0227* (2013.01)

(58) Field of Classification Search

CPC ... F02P 5/04; F02P 5/045; F02D 19/12; F02D 37/02; F02M 25/0227; F02M 25/028; F02B 47/02

See application file for complete search history.

(56) References Cited

U.S. PATENT DOCUMENTS

| | | | | |
|---|---|---|---|---|
| 6,112,705 | A * | 9/2000 | Nakayama | F02B 47/02 123/25 C |
| 9,863,372 | B2 * | 1/2018 | Fujimoto | F02D 19/12 |
| 10,267,243 | B2 * | 4/2019 | McQuillen | F02M 35/10393 |
| 2016/0237974 | A1 | 8/2016 | Pendray | |
| 2017/0022923 | A1 * | 1/2017 | Fujimoto | F02D 19/12 |

FOREIGN PATENT DOCUMENTS

JP 2017-89587 A 5/2017

* cited by examiner

*Primary Examiner* — Phutthiwat Wongwian
*Assistant Examiner* — Hieu T Vo
(74) *Attorney, Agent, or Firm* — Hauptman Ham, LLP

(57) ABSTRACT

A control device for an internal combustion engine which is provided with an engine body, a water injector for injecting water to the inside of an intake passage of the engine body, and a fuel injector for injecting fuel to be made to burn inside a combustion chamber of the engine body. The control device is provided with a water injection control part controlling the amount of injection of water from the water injector in the combustion cycle where fuel is injected from the fuel injector so that water vaporizing inside the intake passage during the suction stroke and water vaporizing inside the combustion chamber during the compression stroke are generated.

3 Claims, 6 Drawing Sheets

CONTROL DEVICE FOR INTERNAL COMBUSTION ENGINE

CROSS-REFERENCE TO RELATED APPLICATION

This application claims priority based on Japanese Patent Application No. 2018-44668 filed with the Japan Patent Office on Mar. 12, 2018, the entire contents of which are incorporated into the present specification by reference.

FIELD

The present disclosure relates to a control device for an internal combustion engine.

BACKGROUND

Japanese Unexamined Patent Publication No. 2017-089587 discloses to inject water into an intake passage of an internal combustion engine and use the latent heat of vaporization of the water to cool the air before flowing into a combustion chamber. Further, it discloses to keep the unevaporated water from ending up flowing into a combustion chamber together with the air by controlling the amount of water injected into the intake passage so that the amount of moisture in the air before flowing into the combustion chamber becomes the saturated steam amount or less.

SUMMARY

However, in the above-mentioned Japanese Unexamined Patent Publication No. 2017-089587, the amount of water vaporizing inside a combustion chamber was not considered at all, so the cooling effect on the air-fuel mixture due to the latent heat of vaporization of water is liable to be unable to be sufficiently obtained.

The present disclosure was made focusing on such a viewpoint and has as its object to improve the cooling effect on an air-fuel mixture due to the latent heat of vaporization of water.

To solve this problem, according to one aspect of the present disclosure, there is provided a control device for an internal combustion engine equipped with an engine body, a water injector for injecting water to the inside of an intake passage of the engine body, and a fuel injector for injecting fuel to be burned in a combustion chamber of the engine body, wherein the control device comprises a water injection control part configured to control the amount of injection of water from the water injector so that in a combustion cycle in which fuel is injected from the fuel injector, water vaporizing in the intake passage during an intake stroke and water vaporizing in a combustion chamber during a compression stroke are generated.

According to this aspect of the present disclosure, it is possible to make water vaporize not only inside an intake passage, but also inside a combustion chamber, so it is possible to improve the cooling effect on an air-fuel mixture due to the latent heat of vaporization of water.

DESCRIPTION OF EMBODIMENTS

Figure 1:
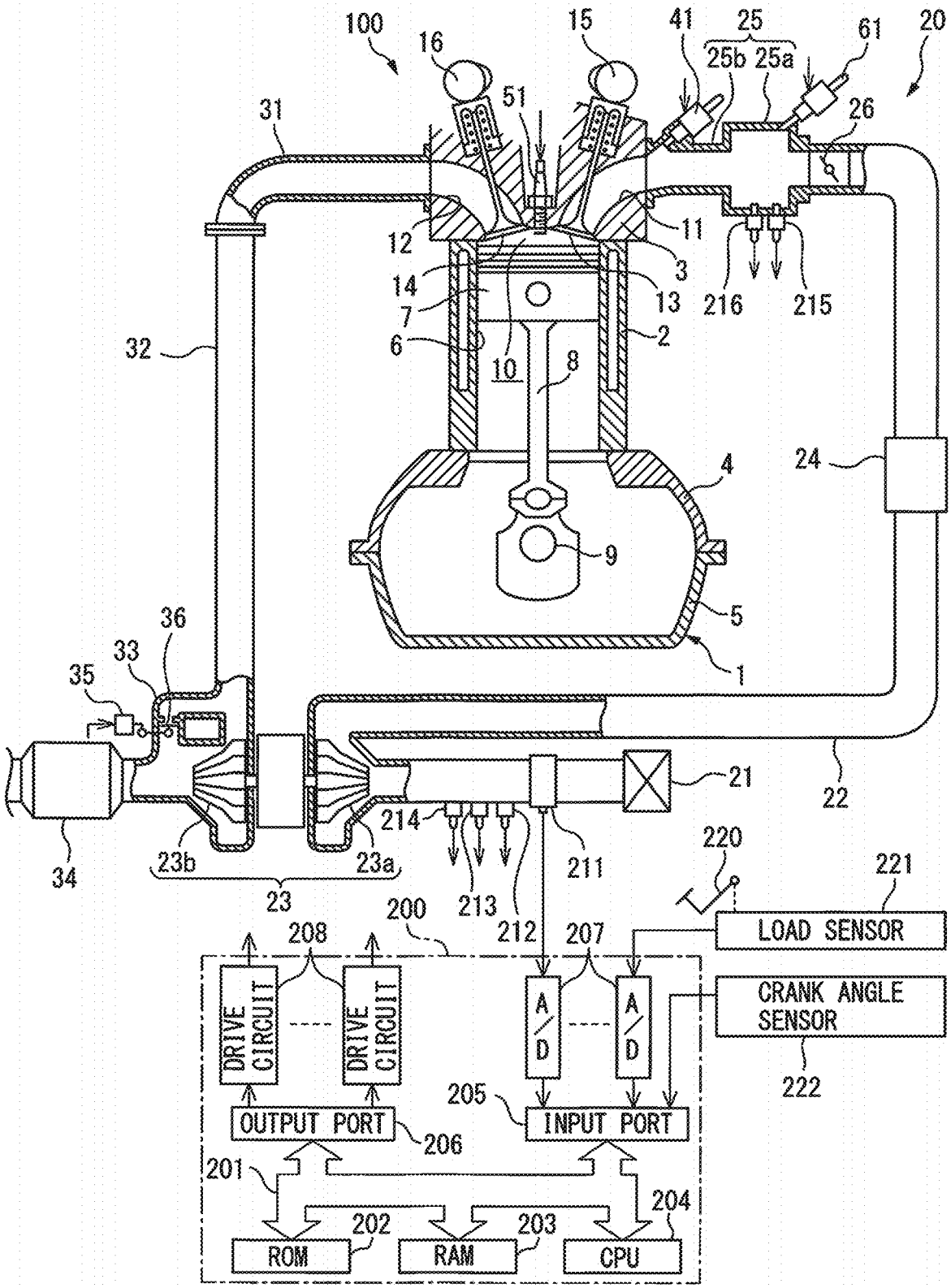
FIG. 1 is a schematic view of the configuration of an internal combustion engine and an electronic control unit for controlling the internal combustion engine according to one embodiment of the present disclosure.

Below, referring to the drawings, an embodiment of the present disclosure will be explained in detail. Note that in the following explanation, similar component elements are assigned the same reference signs.

FIG. 1 is a schematic view of the configuration of an internal combustion engine 100 and an electronic control unit 200 controlling the internal combustion engine 100 according to one embodiment of the present disclosure.

As shown in FIG. 1, the internal combustion engine 100 comprises an engine body 1, an intake system 20, an exhaust system 30, fuel injectors 41, spark plugs 51, and a water injector 61.

The engine body 1 comprises a cylinder block 2, a cylinder head 3 attached to a top part of the cylinder block 2, a crankcase 4 attached to a bottom part of the cylinder block 2, and an oil pan 5 attached to a bottom part of the crankcase 4.

The cylinder block 2 is formed with a plurality of cylinders 6. Inside of the cylinders 6, pistons 7 receiving combustion pressure and reciprocating inside the cylinders 6 are held. The pistons 7 are connected through connecting rods 8 to a crankshaft 9 supported rotatably inside the crankcase 4. Due to the crankshaft 9, the reciprocating motions of the pistons 7 are converted to rotary motion. The spaces defined by the inside wall surface of the cylinder head 3, the inside walls surfaces of the cylinders 6, and the piston crown surfaces form combustion chambers 10.

The cylinder head 3 is formed with intake ports 11 opening at one side surface of the cylinder head 3 and opening into the combustion chambers 10 and exhaust ports 12 opening at the other side surface of the cylinder head 3 and opening into the combustion chambers 10.

Further, at the cylinder head 3, intake valves 13 for opening and closing openings between the combustion chambers 10 and intake ports 11, exhaust valves 14 for opening and closing openings between the combustion chambers 10 and exhaust ports 12, an intake camshaft 15 driving operation of the intake valves 13, and an exhaust camshaft 16 driving operation of the exhaust valves 14 are attached.

The intake system 20 is a system for guiding air through the intake ports 11 to the insides of the individual combustion chambers 10 and comprises an air cleaner 21, intake pipe 22, compressor 23*a* of a turbocharger 23, intercooler 24, intake manifold 25, electronic control type throttle valve 26, air flow meter 211, outside air temperature sensor 212, outside air pressure sensor 213, outside air humidity sensor 214, surge tank temperature sensor 215, and surge tank pressure sensor 216.

The air cleaner 21 removes sand and other foreign matter contained in the air.

The intake pipe 22 is connected at one end to the air cleaner 21 and is connected at the other end to a surge tank 25*a* of the intake manifold 25.

The turbocharger 23 is one type of supercharger. It utilizes the energy of the exhaust to forcibly compress air and send the compressed air to the individual combustion chambers 10. Due to this, the charging efficiency is raised, so the engine output increases. The compressor 23*a* is a part forming a portion of the turbocharger 23 and is provided at the intake pipe 22. The compressor 23*a* is turned by a turbine 23*b* of the turbocharger 23 explained later provided coaxially and forcibly compresses the air. Note that instead of the turbocharger 23, it is also possible to use a supercharger which is mechanically driven utilizing the rotational force of the crankshaft 9.

The intercooler 24 is provided at the intake pipe 22 downstream from the compressor 23*a* and cools the air which was compressed by the compressor 23*a* and became high in temperature. Due to this, it is possible to keep down the drop in volume density and further raise the charging efficiency and to keep down the rise in temperature of the air-fuel mixture due to high temperature air being sucked into the individual combustion chambers 10 so as to keep knocking etc. from occurring.

The intake manifold 25 is provided with the surge tank 25*a* and a plurality of intake runners 25*b* branched from the surge tank 25*a* and connected to openings of individual intake ports 11 formed at the side surface of the cylinder head. The air guided into the surge tank 25*a* is evenly distributed through the intake runners 25*b* to the insides of the individual combustion chambers 10. In this way, the intake pipe 22, intake manifold 25, and intake ports 11 form the intake passage for guiding air to the insides of the individual combustion chambers 10.

The throttle valve 26 is provided at the inside of the intake pipe 22 between the intercooler 24 and the surge tank 25*a*. The throttle valve 26 is driven by a throttle actuator (not shown) and changes the passage cross-sectional area of the intake pipe 22 continuously or in stages. By using the throttle actuator to adjust the opening degree of the throttle valve 26, it is possible to adjust the flow rate of air sucked into the individual combustion chambers 10.

The air flow meter 211 is provided inside the intake pipe 22 at the upstream side from the compressor 23*a*. The air flow meter 211 detects the flow rate of air flowing through the inside of the intake passage and finally sucked into the individual combustion chambers 10.

The outside air temperature sensor 212 is provided inside the intake pipe 22 at the upstream side from the compressor 23*a*. The outside air temperature sensor 212 detects the temperature of the air sucked into the intake pipe 22 at the upstream side from the compressor 23*a* through the air cleaner 23*a*, that is, the outside air temperature.

The outside air pressure sensor 213 is provided inside the intake pipe 22 at the upstream side from the compressor 23*a*. The outside air pressure sensor 213 detects the pressure of the air sucked into the intake pipe 22 at the upstream side from the compressor 23*a* through the air cleaner 23*a*, that is, the outside air pressure (atmospheric pressure).

The outside air humidity sensor 214 is provided inside the intake pipe 22 at the upstream side from the compressor 23*a*. The outside air humidity sensor 214 detects the humidity of the air sucked into the intake pipe 22 at the upstream side from the compressor 23*a* through the air cleaner 21, that is, the outside air humidity.

The surge tank temperature sensor 215 is provided inside the surge tank 25*a*. The surge tank temperature sensor 215 detects the temperature of the air inside the surge tank (below, referred to as the "surge tank temperature"). The surge tank temperature corresponds to the temperature of the air finally sucked into the combustion chambers.

The surge tank pressure sensor 216 is provided inside the surge tank 25*a*. The surge tank pressure sensor 216 detects the pressure of the air inside the surge tank (below, referred to as the "surge tank pressure"). The surge tank pressure corresponds to the pressure of the air finally sucked into the combustion chambers.

The exhaust system 30 is a system for purifying combustion gas (exhaust) generated inside the combustion chambers 10 and discharging it into the outside air and is provided with an exhaust manifold 31, exhaust pipe 32, turbine 23*b* of a turbocharger 23, exhaust bypass passage 33, and exhaust post-treatment device 34.

The exhaust manifold 31 is provided with a plurality of exhaust runners connected to openings of individual exhaust ports 12 formed at a side surface of the cylinder head and a header bundling the exhaust runners into one.

The exhaust pipe 32 is connected at one end to a header of the exhaust manifold 31 and is open at the other end. Exhaust discharged from the individual cylinders 6 through the exhaust ports 12 to the exhaust manifold 31 flows through the exhaust pipe 32 and is discharged to the outside air.

The turbine 23*b* is a part forming a portion of the turbocharger 23 and is provided at the exhaust pipe 32. The turbine 23*b* is turned by the energy of the exhaust and drives a compressor 23*a* provided coaxially.

The exhaust bypass passage 33 is a passage connected to the exhaust pipe 32 at the upstream side of the turbine 23*b* and the exhaust pipe 32 at the downstream side so as to bypass the turbine 23*b*.

The exhaust bypass passage 33 is provided with a wastegate valve 36 driven by a wastegate actuator 35 and is able to adjust the passage cross-sectional area of the exhaust bypass passage 33 continuously or in stages. If the wastegate valve 36 is opened, part or all of the exhaust flowing through the exhaust pipe 32 flows into the exhaust bypass passage 33, bypasses the turbine 23*b*, and is discharged to the outside air. For this reason, by adjusting the opening degree of the wastegate valve 36, it is possible to adjust the flow rate of the exhaust flowing into the turbine 23*b* and control the rotational speed of the turbine 23*b*. That is, by adjusting the opening degree of the wastegate valve 36, it is possible to control the pressure of the air compressed by the compressor 23*a*.

The exhaust post-treatment device 34 is provided in the exhaust pipe 32 at the downstream side from the turbine 23*b*. The exhaust post-treatment device 34 is a device for purifying exhaust, then discharging it to the outside air and comprises various catalysts for removing harmful substances (for example, three-way catalysts) supported on a support.

The fuel injectors 41 inject fuel for being burned inside the individual combustion chambers 10. In the present embodiment, the fuel injectors 41 are attached to the individual intake runners 25*b* of the intake manifold 25 so as to enable fuel to be injected into the intake ports 11. The opening times (amounts of injection) and opening timings (timings of injection) of the fuel injectors 41 are changed by control signals from the electronic control unit 200. If the fuel injectors 41 open, fuel is injected from the fuel injectors 41 to the insides of the intake ports 11 and fuel is supplied to the combustion chambers 10. Note that the fuel injectors 4 may also be attached to the cylinder head 3 so as to enable fuel to be directly injected to the insides of the combustion chambers 10.

The spark plugs 51 are attached to the cylinder head 3 so as to face the combustion chambers 10. The spark plugs 51 generate sparks inside the combustion chambers 10 to ignite the air-fuel mixture of the fuel injected from the fuel injectors 41 and the air. The ignition timings of the spark plugs 51 are controlled to any timings by control signals from the electronic control unit 200.

The water injector 61 injects water for vaporization inside the intake passage and inside the combustion chambers 10 into the intake passage. In the present embodiment, the water injector 61 is attached to the surge tank 25*a* and injects water inside the surge tank 25*a*. The opening time (amount of injection) and opening timing (timing of injection) of the water injector 61 are changed by control signals from the electronic control unit 200. If the water injector 61 is opened, water is injected from the water injector 61 to the inside of the surge tank 25*a*. The water injected to the inside of the surge tank 25*a* is vaporized in the process of flowing through the intake passage while being supplied to the insides of the individual combustion chambers 10 and is vaporized inside the individual combustion chambers 10 during the compression stroke.

The electronic control unit 200 is comprised of a digital computer provided with components connected with each other by a bidirectional bus 201 such as a ROM (read only memory) 202, RAM (random access memory) 203, CPU (microprocessor) 204, input port 205, and output port 206.

The input port 205 receives as input the output signals of various sensors such as the above-mentioned air flow meter 211 through corresponding AD converters 207. Further, the input port 205 receives as input the output voltage of a load sensor 221 generating an output voltage proportional to the amount of depression of the accelerator pedal 220 corresponding to the engine load through a corresponding AD converter 207. Further, the input port 205 receives as input an output signal of a crank angle sensor 222 generating an output pulse every time the crankshaft 9 of the engine body 1 rotates by for example 15° as a signal for calculating the engine rotational speed etc. In this way, the input port 205 receives as input output signals of various sensors required for control of the internal combustion engine 100.

The output port 206 is electrically connected to the fuel injectors 41 and other various control parts through corresponding drive circuits 208.

The electronic control unit 200 outputs control signals for controlling the different control parts from the output port 206 based on the output signals of the various sensors input to the input port 205 to control the internal combustion engine 100. Below, the control of the internal combustion engine 100 according to the present embodiment which the electronic control unit 200 performs will be explained.

The electronic control unit 200 controls the ignition timings of the spark plugs 51 to the optimum ignition timing (MBT; Minimum advance for the Best Torque) or the knock limit ignition timing based on the engine operating state (engine rotational speed and engine load). Specifically, the electronic control unit 200 controls the ignition timings to the optimum ignition timing if there is an engine operating point determined by the engine rotational speed and the engine load inside the operating region where the optimum ignition timing becomes the retarded side from the knock limit ignition timing. On the other hand, the electronic control unit 200 controls the ignition timings to the knock limit ignition timing if there is an engine operating point inside the operating region where the optimum ignition timing becomes the advanced side from the knock limit ignition timing. This is because if making the ignition timings advance from the knock limit ignition timing, over the allowable range of knocking will occur and the engine output and engine durability are liable to fall.

Here, if, in the operating region where the optimum ignition timing becomes the advanced side from the knock limit ignition timing, the ignition timings can be made to approach the optimum ignition timing, the engine output and fuel efficiency can be improved.

Therefore, in the present embodiment, in an operating region where the optimum ignition timing becomes the advanced side from the knock limit ignition timing, water is injected from the water injector 61 and the temperature of the air-fuel mixture finally ignited in the combustion chambers 10 is lowered by the latent heat of vaporization of water. By doing this, knocking can be kept from occurring, so it is possible to make the ignition timings advance from the knock limit ignition timings more than when not injecting water and the ignition timings can be made to approach the optimum ignition timing.

At this time, the cooling effect of the air-fuel mixture due to the latent heat of vaporization of water (temperature lowering effect) differs between the case when making water vaporize inside the intake passage and the case when making water vaporize inside the combustion chambers 10. The cooling effect of the air-fuel mixture becomes larger in the case when making water vaporize inside the combustion chambers 10.

This is because the air or the air-fuel mixture cooled by the latent heat of vaporization of water inside the intake passage ends up rising in temperature due to the heat received from the inside wall surface of the intake passage in the process of flowing through the inside of the intake passage and being sucked into the combustion chambers 10. On the other hand, the time period during which the air-fuel mixture cooled by the latent heat of vaporization of water inside the combustion chambers 10 receives heat from the inside wall surfaces of the combustion chambers 10 is shorter than the time period during which it receives heat from the inside wall surface of the intake passage. Further, the surface areas inside of the combustion chambers 10 are also smaller than the surface area inside the intake passage.

For this reason, the air-fuel mixture cooled by the latent heat of vaporization of water inside the combustion chambers 10 is kept down in rise in temperature more than the air or the air-fuel mixture cooled by the latent heat of vaporization of water inside the intake passage. As a result, the cooling effect of the air-fuel mixture becomes greater when making water vaporize inside the combustion chambers 10.

Therefore, if, like in the above-mentioned patent literature, ending up controlling the amount of water injected from the water injector 61 so that the amount of moisture in the air before flowing into the combustion chambers 10 becomes the saturated steam amount or less, water will not vaporize inside the combustion chambers 10, so sometimes the cooling effect of the air-fuel mixture due to the latent heat of vaporization of water cannot be sufficiently obtained.

Therefore, in the present embodiment, in the combustion cycle where fuel is injected from the fuel injectors 41, the amount of water injected from the water injector 61 is controlled so that water which vaporizes inside the intake passage during the suction stroke and water which vaporizes inside the combustion chambers 10 during the compression stroke are generated. Due to this, it is possible to make water vaporize not only inside the intake passage but also inside the combustion chambers 10, so the cooling effect of the air-fuel mixture due to the latent heat of vaporization of water can be improved and in turn knocking can be kept from occurring.

Further, if in this way enabling the cooling effect of the air-fuel mixture due to the latent heat of vaporization of water to be enhanced and occurrence of knocking to be suppressed, the ignition timing can be made to advance by the amount of improvement of the cooling effect. Therefore, in the present embodiment, it was decided to correct the ignition timings to the advanced side corresponding to the amount of water injected from the water injector 61. Due to this, the engine output and fuel efficiency can be improved.

Below, referring to FIG. 2 to FIG. 6, water injection control and ignition timing control according to the present embodiment will be explained.

Figure 2:
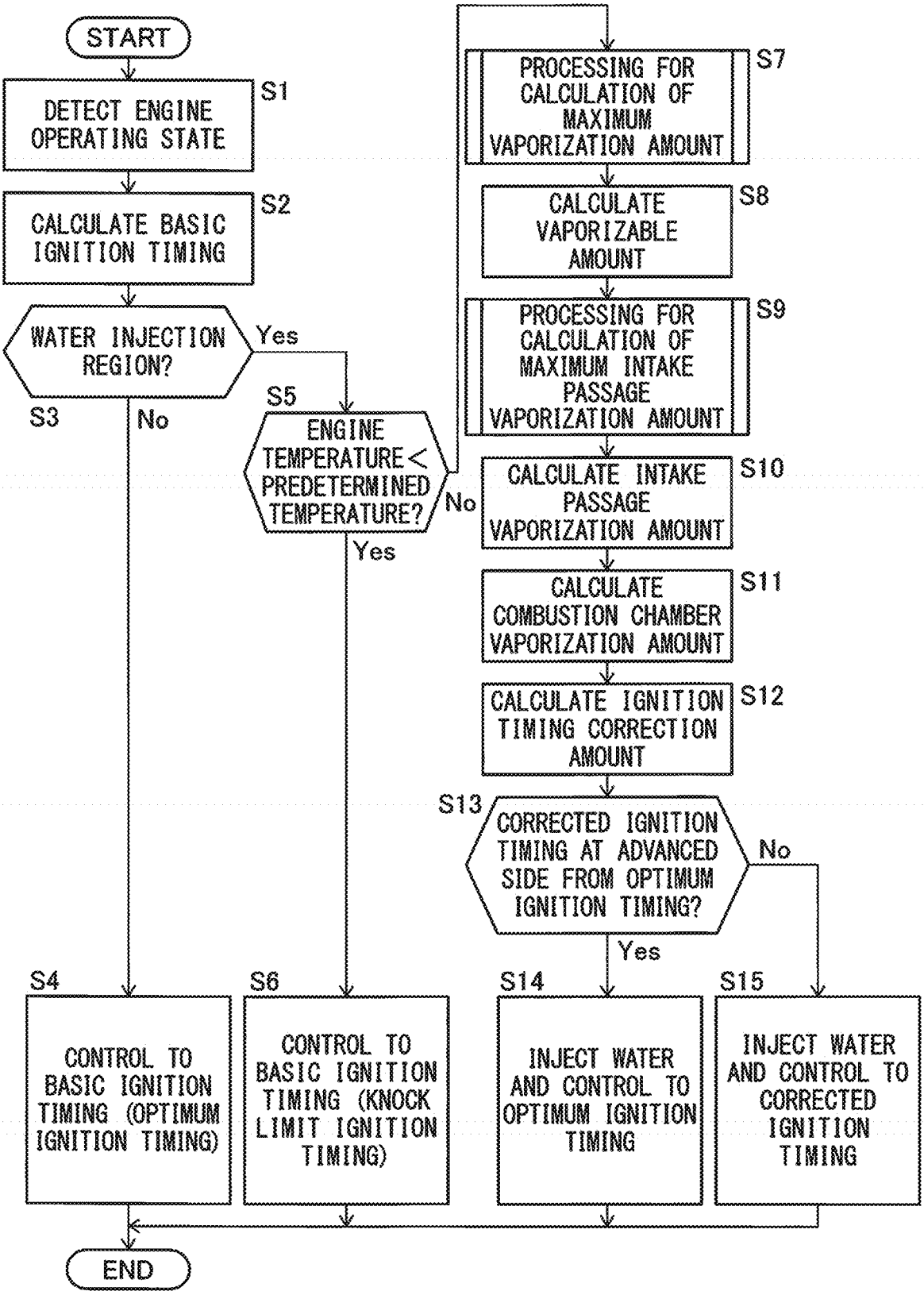
FIG. 2 is a flow chart explaining water injection control and ignition timing control according to one embodiment of the present disclosure.

FIG. 2 is a flow chart explaining the water injection control and ignition timing control according to the present embodiment. The electronic control unit 200 repeatedly executes the present routine by a predetermined processing period during engine operation.

At step S1, the electronic control unit 200 reads in an engine rotational speed calculated by an output signal of the crank angle sensor 222 and an engine load detected by the load sensor 221 and detects the engine operating state (engine operating points).

At step S2, the electronic control unit 200 refers to a map prepared in advance by experiments etc. and calculates a basic ignition timing based on the engine operating state. The "basic ignition timing" is the target ignition timing in the case of not injecting water. Therefore, if not injecting water, when there is an engine operating point inside the operating region where the optimum ignition timing becomes the retarded side from the knock limit ignition timing, the basic ignition timing is set for the optimum ignition timing corresponding to the engine operating state. On the other hand, if not injecting water, when there is an engine operating point inside the operating region where the optimum ignition timing becomes the advanced side from the knock limit ignition timing, the basic ignition timing is set for the knock limit ignition timing corresponding to the engine operating state.

At step S3, the electronic control unit 200 refers to a map prepared in advance by experiments etc. and judges if an engine operating point is within the water injection region. In the present embodiment, if not injecting water, an operating region where the optimum ignition timing ends up becoming the advanced side from the knock limit ignition timing is set for the water injection region. The electronic control unit 200 proceeds to the processing of step S5 if an engine operating point is within the water injection region. On the other hand, the electronic control unit 200 proceeds to the processing of step S4 if an engine operating point is not within the water injection region.

At step S4, the electronic control unit 200 does not inject water and controls the ignition timings to the basic ignition timing, that is, the optimum ignition timing.

At step S5, the electronic control unit 200 judges if the engine temperature is less than a predetermined temperature. The electronic control unit 200 proceeds to the processing of step S6 if the engine temperature is less than a predetermined temperature since water injected from the water injector 61 is liable to be unable to be sufficiently vaporized. On the other hand, the electronic control unit 200 proceeds to the processing of step S7 if the engine temperature is a predetermined temperature or more.

At step S6, the electronic control unit 200 does not inject water, but controls the ignition timings to the basic ignition timing, that is, the knock limit ignition timing.

At step S7, the electronic control unit 200 performs processing for calculating the maximum amount of water WTm which can theoretically be made to vaporize inside the combustion chambers 10 during the compression stroke (below, referred to as the "maximum vaporization amount"). The maximum vaporization amount WTm is a value unambiguously determined by the temperature and pressure inside the combustion chambers 10 during the compression stroke. Below, details on the processing for calculation of the maximum vaporization amount WTm will be explained with reference to FIG. 3.

Figure 3:
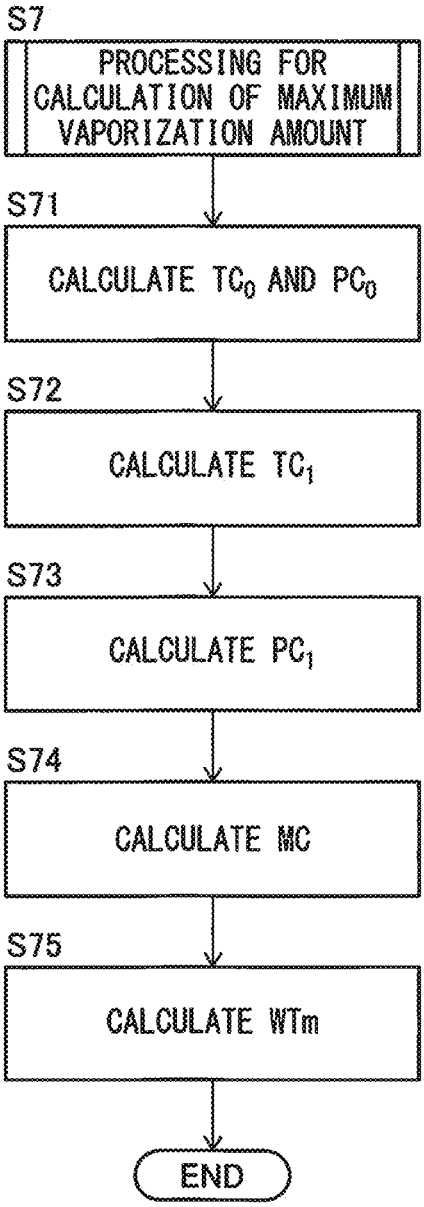
FIG. 3 is a flow chart explaining processing for calculation of a maximum vaporization amount.

FIG. 3 is a flow chart explaining the content of processing for calculation of the maximum vaporization amount WTm.

At step S71, the electronic control unit 200 calculates the temperature $TC_1$ inside the combustion chambers 10 before compression (below, referred to as the "pre-compression combustion chamber temperature") and the pressure $PC_0$ inside the combustion chambers 10 before compression (below, referred to as the "pre-compression combustion chamber pressure"). In the present embodiment, the electronic control unit 200 makes the surge tank temperature the pre-compression combustion chamber temperature $TC_0$ and makes the surge tank pressure the pre-compression combustion chamber pressure $PC_0$.

At step S72, the electronic control unit 200 calculates the temperature $TC_1$ inside of the combustion chambers 10 after compression (below, referred to as the "post-compression combustion chamber temperature") based on the pre-compression combustion chamber temperature $TC_0$ from a formula for estimation of the combustion chamber temperature TC in the case assuming the air-fuel mixture is adiabatically compressed inside the combustion chambers 10, that is, the following formula (1):

$$TC_1 = TC_0 \times (V_0/V_1)^{k-1} \quad (1)$$

In formula (1), $V_0$ is the pre-compression combustion chamber volume, $V_1$ is the post-compression combustion chamber volume, and "k" is the specific heat ratio (polytrope indicator). In the present embodiment, the pre-compression combustion chamber volume $V_0$ is made the cylinder volume at the intake valve closing timing, but for simplicity, it may also be made the cylinder volume when the piston 7 is positioned at bottom dead center. Further, in the present embodiment, the post-compression combustion chamber volume $V_1$ is made the cylinder volume at the basic ignition timing, that is, the cylinder volume at the time of start of combustion, but for simplicity, the cylinder volume at any timing during the compression stroke (for example, cylinder volume when the piston 7 is positioned at top dead center) may also be made the post-compression combustion chamber volume $V_1$.

Note that the cylinder volumes at the intake valve closing timing and basic ignition timing are values which are mechanically determined if the intake valve closing timing and basic ignition timing are determined. Therefore, in the present embodiment, a table linking the intake valve closing timing and the pre-compression combustion chamber volume $V_0$ and a table linking the basic ignition timing and the post-compression combustion chamber volume $V_1$ are respectively prepared in advance by experiments etc. and these tables are referred to so as to calculate the pre-compression combustion chamber volume $V_0$ and post-compression combustion chamber volume $V_1$.

At step S73, the electronic control unit 200 calculates the pressure $PC_1$ inside the combustion chambers 10 after compression (below, referred to as the "post-compression combustion chamber pressure") based on the pre-compression combustion chamber pressure $PC_0$ from a formula for estimation of the combustion chamber pressure PC in the case of assuming the air-fuel mixture is adiabatically compressed in the combustion chambers 10, that is, the following formula (2):

$$PC_1=PC_0\times(V_0/V_1)^k \quad (2)$$

At step S74, the electronic control unit 200 refers to a map linking the pressure and temperature with the saturated steam amount and calculates the saturated steam amount MC [g/m$^3$] inside the combustion chambers 10 after compression, that is, inside the combustion chambers 10 at the basic ignition timing, based on the post-compression combustion chamber temperature $TC_1$ and post-compression combustion chamber pressure $PC_1$.

At step S75, the electronic control unit 200 subtracts from the saturated steam amount MC inside the combustion chambers 10 at the basic ignition timing the amount of moisture per unit volume contained in the outside air calculated based on the outside air humidity and multiplies the result with the post-compression combustion chamber volume $V_1$ to calculate the maximum vaporization amount WTm.

Returning to FIG. 2, at step S8, the electronic control unit 200 corrects the maximum vaporization amount WTm while considering the time from the timing of closing of the intake valve to the basic ignition timing (below, "first vaporization time") etc., makes it actually vaporize inside the combustion chambers 10 within the first vaporization time, and, further, calculates the estimated amount of water WT enabling the vaporized water (steam) to fully diffuse inside the combustion chambers 10 (below, referred to as the "vaporizable amount"). This vaporizable amount WT becomes the target injection amount of water injected from the water injector 61. In the present embodiment, the electronic control unit 200 calculates the vaporizable amount WT based on the following formula (3). Note that the first vaporization time for simplicity sake may also be made the time from when a piston 7 moves from bottom dead center to top dead center.

$$WT=WTm\times c1\times c2 \quad (3)$$

In formula (3), the first correction coefficient c1 is a coefficient considering the error in calculation of the maximum vaporization amount WTm and is a positive value of less than 1 (for example, 0.8). The second correction coefficient c2 is a coefficient considering the first vaporization time and is set to a positive value of less than 1 corresponding to the engine rotational speed. Specifically, the first vaporization time becomes shorter the higher the engine rotational speed, so the second correction coefficient c2 is basically set to a smaller value when the engine rotational speed is high compared to when it is low.

At step S9, the electronic control unit 200 performs processing for calculation of the maximum amount of water WSm theoretically able to be made to vaporize inside the intake passage (below, referred to as the "maximum intake passage vaporization amount"). The maximum intake passage vaporization amount WSm is a value unambiguously determined by the temperature and pressure of the air inside of the intake passage, but the temperature and pressure of the air inside the intake passage change in the process of the air flowing through the inside of the intake passage.

Therefore, the maximum intake passage vaporization amount WSm is preferably calculated based on the temperature and pressure inside the intake passage after the temperature and pressure inside of the intake passage finish fluctuating. In the present embodiment, the temperature and pressure of the air inside the intake passage fluctuate due to air being compressed by the compressor 23*a*, fluctuate due to air being cooled by the intercooler 24, and further fluctuate due to air being reduced in pressure corresponding to the opening degree of the throttle valve 26. Therefore, in the present embodiment, the maximum intake passage vaporization amount WSm is calculated based on the temperature and pressure in the intake passage at the downstream side from the throttle valve 26 in the direction of flow of intake (in the present embodiment, the surge tank temperature and surge tank pressure). Below, details of the processing for calculation of the maximum intake passage vaporization amount WSm will be explained while referring to FIG. 4.

Figure 4:
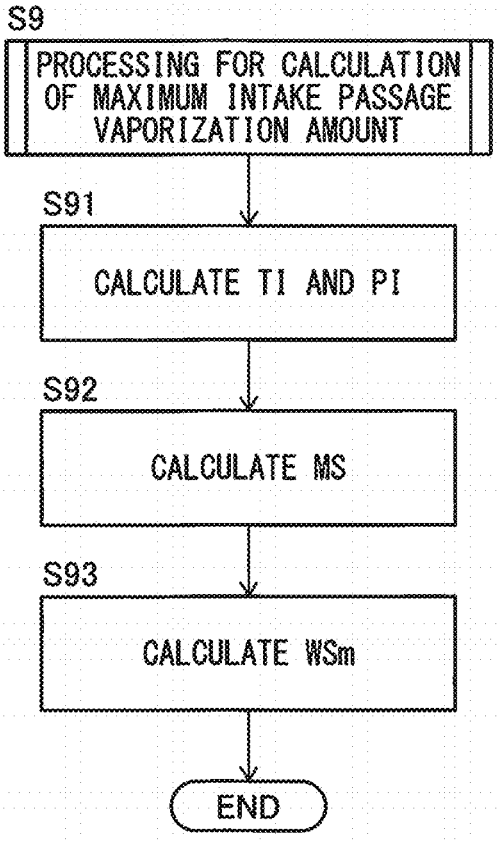
FIG. 4 is a flow chart explaining processing for calculation of a maximum intake passage vaporization amount.

FIG. 4 is a flow chart explaining the content of the processing for calculation of the maximum intake passage vaporization amount WSm.

At step S91, the electronic control unit 200 calculates the temperature TI inside the intake passage at the downstream side from the throttle valve 26 in the direction of flow of intake (below, referred to as the "intake passage temperature") and the pressure PI inside the intake passage at the downstream side from the throttle valve 26 in the direction of flow of intake (below, referred to as the "intake passage pressure"). In the present embodiment, the electronic control unit 200 makes the surge tank temperature the intake passage temperature TI and makes the surge tank pressure the intake passage pressure PI.

At step S92, the electronic control unit 200 refers to a map linking the pressure and temperature with the saturated steam amount and calculates the saturated steam amount MS [g/m$^3$] inside the intake passage at the downstream side from the throttle valve 26 in the direction of flow of intake based on the intake passage temperature TI and the intake passage pressure PI.

At step S93, the electronic control unit 200 multiplies the saturated steam amount MS inside the intake passage at the downstream side of the throttle valve 26 in the direction of flow of intake with the volume inside of the intake passage at the downstream side of the throttle valve 26 in the direction of flow of intake to calculate the maximum intake passage vaporization amount WSm.

Returning to FIG. 2, at step S10, the electronic control unit 200 corrects the maximum intake passage vaporization amount WSm while considering the time until the water injected from the water injector 61 flows inside of the combustion chambers 10 (below, referred to as the "second vaporization time") and calculates the estimated amount of the water actually able to be made to vaporize inside the intake passage in a second vaporization time (below, referred to as the "intake passage vaporization amount") WS. In the present embodiment, the electronic control unit 200 calculates the intake passage vaporization amount WS based on the following formula (4):

$$WS=WSm\times c3 \quad (4)$$

In formula (4), the third correction coefficient c3 is a coefficient considering the second vaporization time and is set to a positive number of less than 1 corresponding to the engine rotational speed. Specifically, the second vaporization time becomes shorter the higher the engine rotational speed, so the third correction coefficient c3 is basically set to a small value when the engine rotational speed is high compared to when it is low.

At step S11, the electronic control unit 200 subtracts the intake passage vaporization amount WS from the vaporizable amount WT and calculates the estimated amount of water WC vaporizing after flowing into the combustion chamber 10 in the water injected from the water injector 61 (below, referred to as the "combustion chamber vaporization amount").

At step S12, the electronic control unit 200 calculates the ignition timing correction amount dsa. In the present embodiment, the electronic control unit 200 refers to the table of FIG. 5 prepared in advance by experiments etc. and calculates the first ignition timing correction amount gc based on the combustion chamber vaporization amount WC. Further, the electronic control unit 200 refers to the table of FIG. 6 prepared in advance by experiments etc. and calculates the second ignition timing correction amount gs based on the intake passage vaporization amount WS. Further, the electronic control unit 200 calculates the sum of the first ignition timing correction amount gc and the second ignition timing correction amount gs as the ignition timing correction amount dsa.

Figure 5:
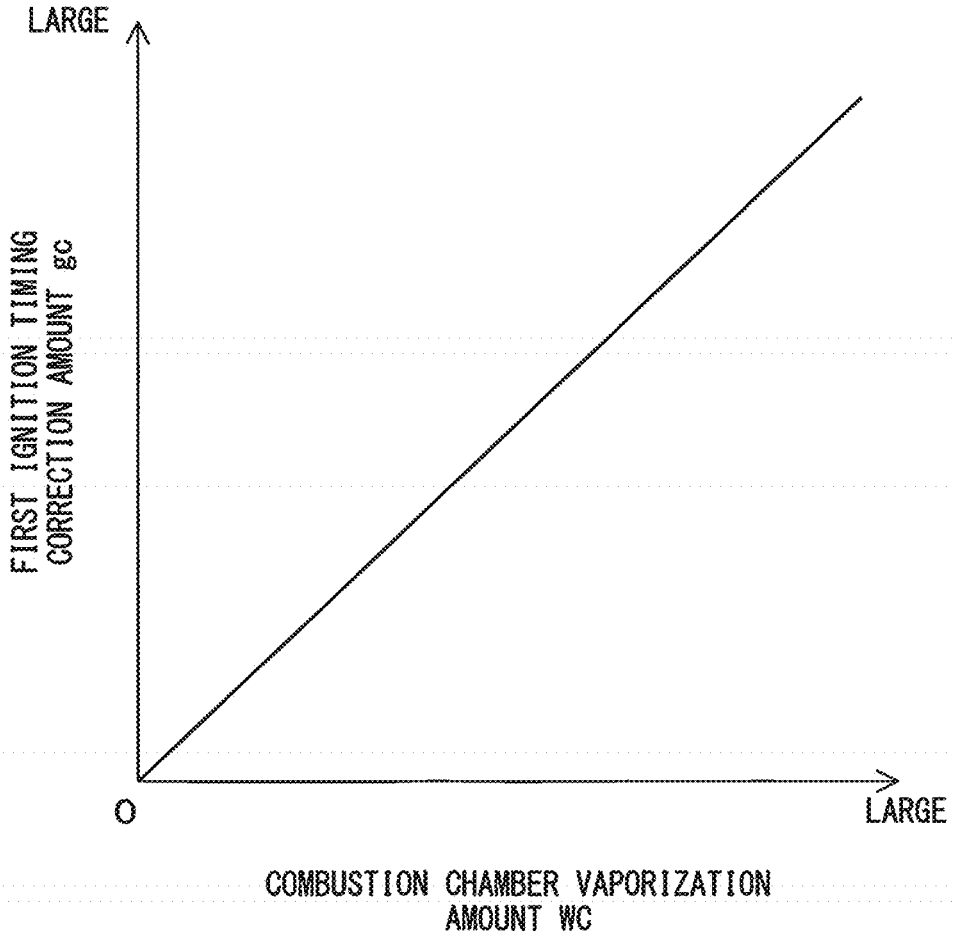
FIG. 5 is a table for calculating a first ignition timing correction amount based on a combustion chamber vaporization amount.
Figure 6:
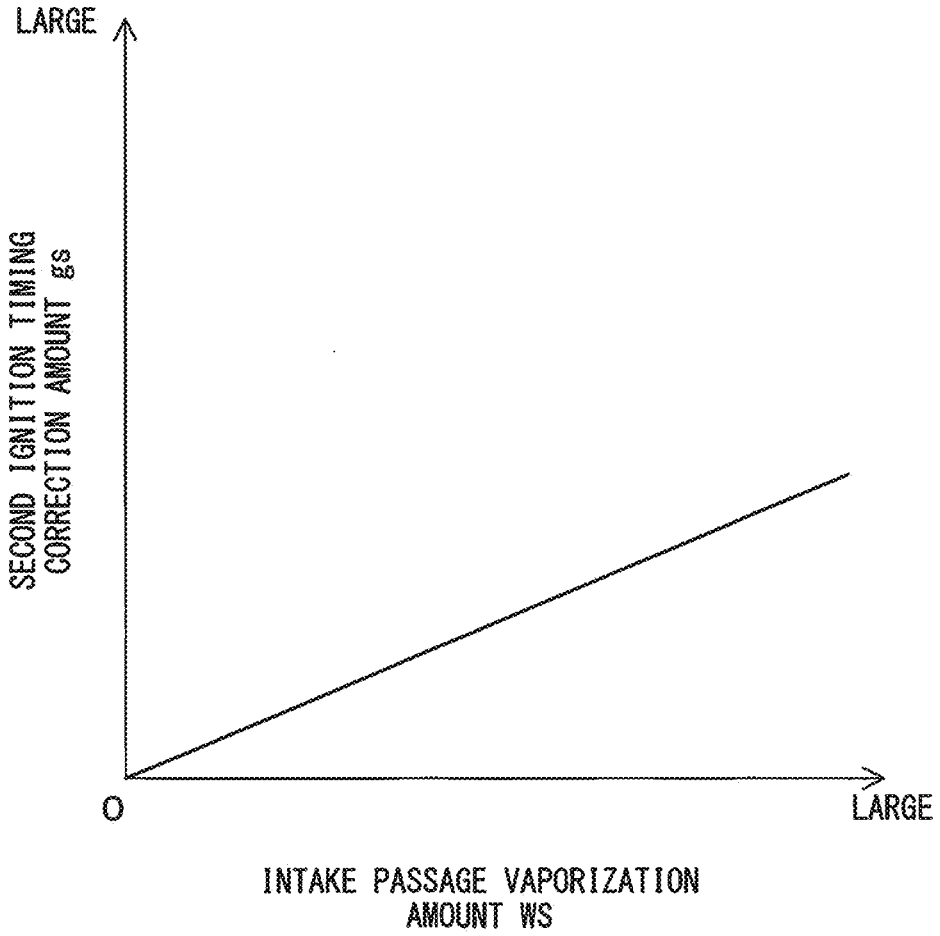
FIG. 6 is a table for calculation of a second ignition timing correction amount based on an intake passage vaporization amount.

As shown in FIG. 5 and FIG. 6, if comparing the first ignition timing correction amount gc and the second ignition timing correction amount gs in the case where the combustion chamber vaporization amount WC and the intake passage vaporization amount WS are the same, the first ignition timing correction amount gc becomes larger than the second ignition timing correction amount gs. This is because, as explained above, the cooling effect of the air-fuel mixture due to the latent heat of vaporization of water becomes larger in the case of making water vaporize inside the combustion chambers 10 compared with the case of making water vaporize inside the intake passage.

At step S13, the electronic control unit 200 judges if the corrected ignition timing obtained by subtracting the ignition timing correction amount dsa from the basic ignition timing (knock limit ignition timing) becomes the advanced side from the optimum ignition timing. The electronic control unit 200 proceeds to the processing of step S14 if the corrected ignition timing is at the advanced side from the optimum ignition timing. On the other hand, the electronic control unit 200 proceeds to the processing of step S15 if the corrected ignition timing is at the retarded side from the optimum ignition timing.

At step S14, the electronic control unit 200 injects the vaporizable amount WT of water at any timing during the suction stroke from the water injector 61 and controls the ignition timing to the optimum ignition timing.

At step S15, the electronic control unit 200 injects the vaporizable amount WT of water from the water injector 61 at any timing during the suction stroke and controls the ignition timing to the corrected ignition timing.

According to the present embodiment explained above, there is provided an electronic control unit 200 (control device) of an internal combustion engine 100 which is provided with an engine body 1, a water injector 61 for injecting water inside of an intake passage of the engine body 1, and a fuel injector 41 for injecting fuel for burning in a combustion chamber 10 of the engine body 1. The electronic control unit 200 is provided with a water injection control part controlling the amount of injection of water from the water injector 61 in the combustion cycle in which fuel is injected from the fuel injector 41 so that water which vaporizes inside the intake passage during the suction stroke and water which vaporizes inside the combustion chambers 10 during the compression stroke are generated.

Specifically, the water injection control part is configured so as to control the amount of injection of water from the water injector 61 so that the amount of injection of water from the water injector 61 becomes the total of the amount of water which vaporizes inside the intake passage, defined as the intake passage vaporization amount WS, and the amount of water which vaporizes inside the combustion chambers 10 in the compression stroke after flowing into the combustion chambers 10, defined as the combustion chamber vaporization amount WC.

As explained above, the cooling effect of the air-fuel mixture due to the latent heat of vaporization of water (temperature lowering effect) differs between the case of making water vaporize inside the intake passage and the case of making water vaporize inside the combustion chambers 10. The cooling effect of the air-fuel mixture becomes larger in the case of making the water vaporize in the combustion chambers 10. For this reason, by controlling the amount of injection of water so that water which vaporizes not only inside the intake passage, but also inside the combustion chambers 10 is formed like in the present embodiment, it is possible to raise the cooling effect of the air-fuel mixture.

Further, by enhancing the cooling effect of the air-fuel mixture, it is possible to reduce the temperature of the exhaust. For this reason, if the electronic control unit 200 is configured to perform control for correcting the fuel injection amount to increase it when the catalyst temperature becomes a predetermined value or more so as to for example prevent overheating of the catalyst of the exhaust post-treatment device 34 (so-called OT increasing correction), it is possible to reduce the frequency of correcting the fuel injection amount to increase it. For this reason, it is possible to keep the fuel efficiency from deteriorating.

Further, the electronic control unit 200 according to the present embodiment is further comprised of an ignition timing control part controlling the ignition timing of the spark plugs 51 for igniting the air-fuel mixture inside the combustion chambers 10 based on the engine operating state and an ignition timing correction part correcting the ignition timings to the advanced side based on the amount of injection of water from the water injector 61. Further, the ignition timing correction part is configured to calculate the first ignition timing correction amount gc based on the combustion chamber vaporization amount WC, calculate the second ignition timing correction amount gs based on the intake passage vaporization amount WS, and correct the ignition timings to the advanced side based on the total amount of the first ignition timing correction amount gc and the second ignition timing correction amount gs, defined as the "ignition timing correction amount dsa".

In this way, if using spark plugs 51 to ignite the air-fuel mixture, by controlling the water injection amount so that water vaporizing not only inside the intake passage but also inside the combustion chambers 10 is formed and enhancing the cooling effect of the air-fuel mixture, it is possible to keep knocking from occurring. For that reason, it is possible to correct the ignition timing to the advanced side according to the water injection amount and possible to improve the engine output and fuel efficiency.

Further, as explained above, the cooling effect of the air-fuel mixture due to the latent heat of vaporization of water differs between the case of making water vaporize inside the intake passage and the case of making water vaporize inside the combustion chambers 10. If correcting the ignition timings to the advanced side according to the water injection amount, the ignition timing amount able to be advanced based on the combustion chamber vaporization amount WC and the ignition timing amount able to be advanced based on the intake passage vaporization amount WS also differ.

Therefore, like in the present embodiment, by calculating the first ignition timing correction amount gc based on the combustion chamber vaporization amount WC and calculating the second ignition timing correction amount gs based on the intake passage vaporization amount WS, it is possible to respectively calculate suitable ignition timing correction amounts corresponding to the cooling effect of the air-fuel mixture in the case of making water vaporize inside the intake passage and the cooling effect of the air-fuel mixture in the case of making water vaporize inside the combustion chambers 10.

Further, the water injection control part according to the present embodiment is configured to calculate the maximum amount of water which can be made to vaporize inside the combustion chambers 10 during the compression stroke, that is, the maximum vaporization amount WTm, based on the saturated steam amount MC inside the combustion chambers 10 as determined according to the state inside the combustion chambers 10 during the compression stroke, calculate the estimated amount of water which can actually be made to vaporize inside the combustion chambers 10 during the compression stroke, that is, the vaporizable amount WT, based on the maximum vaporization amount WTm and the first vaporization time of water inside the combustion chambers 10 as it changes according to the engine rotational speed, and control the amount of injection of water from the water injector 61 while deeming the vaporizable amount WT as the total amount of the intake passage vaporization amount WS and the combustion chamber vaporization amount WC.

Furthermore, the water injection control part is configured to calculate the maximum amount of water which can be made to vaporize inside the intake passage, that is, the maximum intake passage vaporization amount WSm, based on the saturated steam amount MS inside the intake passage determined according to the state inside the intake passage, calculate the intake passage vaporization amount WS based on the maximum intake passage vaporization amount WSm and the second vaporization time of water inside the intake passage as it changes according to the engine rotational speed, and calculate the combustion chamber vaporization amount WC based on the vaporizable amount WT and intake passage vaporization amount WS.

Due to this, the intake passage vaporization amount WS and the combustion chamber vaporization amount WC can be calculated precisely. In controlling the amount of injection of water from the water injector 61 so that water vaporizing inside the intake passage during the suction stroke and water vaporizing inside the combustion chambers 10 during the compression stroke are generated, it is possible to control the water injection amount to a suitable amount. That is, it is possible to keep water from being excessively injected and to conversely keep water from becoming insufficient and a sufficient cooling effect from no longer being able to be obtained.

Above, an embodiment of the present disclosure was explained, but the embodiment only shows part of the examples of application of the present disclosure. It is not meant to limit the technical scope of the present disclosure to the specific constitution of the above embodiment.

For example, if the internal combustion engine 100 is provided with an exhaust gas recirculation system for making part of the exhaust gas discharged from the combustion chambers 10 be recirculated to the intake passage, it is also possible to consider the exhaust gas recirculation rate (EGR rate) in calculating the intake passage vaporization amount WS.

Further, in the above embodiment, a spark ignition type internal combustion engine 100 was explained as an example, but in a premix compression ignition type internal combustion engine or an internal combustion engine making fuel burn by diffusion, it is also possible to perform the water injection control explained in the above embodiment if there is a demand for reducing the temperature of the intake air or air-fuel mixture inside the combustion chambers.

The invention claimed is:

1. A control device for an internal combustion engine,
the internal combustion engine comprising:
an engine body;
a water injector for injecting water inside of an intake passage of the engine body; and
a fuel injector for injecting fuel made to burn inside a combustion chamber of the engine body, wherein
the control device comprises a water injection control part configured to control an amount of injection of water from the water injector in a combustion cycle where fuel is injected from the fuel injector so that water which vaporizes inside the intake passage during the suction stroke and water which vaporizes inside the combustion chamber during the compression stroke are formed,
the water injection control part is configured to control the amount of injection of water from the water injector so that the amount of injection of water from the water injector becomes a total of the amount of water which vaporizes inside the intake passage, defined as the intake passage vaporization amount, and the amount of water which vaporizes inside the combustion chamber in the compression stroke after flowing into the combustion chamber, defined as the combustion chamber vaporization amount,
the control device further comprises:
an ignition timing control part configured so as to control an ignition timing of a spark plug for igniting fuel inside the combustion chamber based on the engine operating state; and
an ignition timing correction part configured so as to correct the ignition timing to the advanced side based on the amount of injection of water from the water injector, and
the ignition timing correction part is configured so as to:
calculate the first ignition timing correction amount based on the combustion chamber vaporization amount,
calculate the second ignition timing correction amount based on the intake passage vaporization amount, and
correct the ignition timing to the advanced side based on the total of the first ignition timing correction amount and the second ignition timing correction amount.

2. The control device according to claim 1, wherein
the water injection control part is configured to:
calculate the maximum amount of water able to be made to vaporize inside the combustion chamber during the compression stroke, defined as the maximum vaporization amount, based on a saturated steam amount inside the combustion chamber as determined according to the state inside the combustion chamber during the compression stroke, calculate the estimated amount of water able to be made to actually vaporize inside the combustion chamber during the compression stroke, defined as the vaporizable amount, based on the maximum vaporization amount and the vaporization time of water inside the combustion chamber as changing according to the engine rotational speed, and control the amount of injection of water from the water injector using the vaporizable amount as the total amount.

3. The control device according to claim 2, wherein the water injection control part is configured to:

calculate the maximum amount of water able to be made to vaporize inside the intake passage, defined as the maximum intake passage vaporization amount, based on the amount of saturated steam inside the intake passage as determined according to the state inside the intake passage, calculate the intake passage vaporization amount based on the maximum intake passage vaporization amount and the vaporization time of water inside the intake passage as changing according to the engine rotational speed, and calculate the combustion chamber vaporization amount based on the vaporizable amount and the intake passage vaporization amount.

* * * * *